US008969271B2

(12) United States Patent
Greaves et al.

(10) Patent No.: US 8,969,271 B2
(45) Date of Patent: Mar. 3, 2015

(54) POLYAKYLENE GLYCOLS USEFUL AS LUBRICANT ADDITIVES FOR GROUPS I-IV HYDROCARBON OILS

(75) Inventors: Martin R. Greaves, Hirzel (CH); Ronald Vanvoorst, Vogelwaarde (NL); Marinus Meertens, Terneuzen (NL); Nadjet Khelidj, Thalwil (CH); Evelyn Zaugg-Hoozemans, Horgen (CH)

(73) Assignee: Dow Global Technologies LLC, Midland, MI (US)

( * ) Notice: Subject to any disclaimer, the term of this patent is extended or adjusted under 35 U.S.C. 154(b) by 604 days.

(21) Appl. No.: 13/379,109

(22) PCT Filed: Jul. 23, 2010

(86) PCT No.: PCT/US2010/043001

§ 371 (c)(1),
(2), (4) Date: Dec. 19, 2011

(87) PCT Pub. No.: WO2011/011656

PCT Pub. Date: Jan. 27, 2011

(65) Prior Publication Data

US 2012/0108482 A1 May 3, 2012

Related U.S. Application Data

(60) Provisional application No. 61/227,833, filed on Jul. 23, 2009.

(51) Int. Cl.
*C10M 107/34* (2006.01)
*C10M 111/04* (2006.01)

(52) U.S. Cl.
CPC ..... *C10M 107/34* (2013.01); *C10M 111/04* (2013.01); *C10M 2203/1006* (2013.01); *C10M 2203/1025* (2013.01); *C10M 2205/0285* (2013.01); *C10M 2209/1055* (2013.01); *C10M 2209/107* (2013.01); *C10M 2209/1075* (2013.01); *C10N 2220/022* (2013.01); *C10N 2230/64* (2013.01); *C10N 2230/70* (2013.01)
USPC ..... 508/579

(58) Field of Classification Search
USPC ..... 508/579
See application file for complete search history.

(56) References Cited

U.S. PATENT DOCUMENTS

| | | | |
|---|---|---|---|
| 2,620,304 | A | 12/1952 | Stewart et al. |
| 3,843,535 | A | 10/1974 | Denis et al. |
| 4,259,405 | A | 3/1981 | Newkirk et al. |
| 4,481,123 | A | 11/1984 | Hentschel et al. |
| 4,793,939 | A | 12/1988 | Mori et al. |
| 5,053,154 | A | 10/1991 | Oppenlaender et al. |
| 5,681,797 | A | 10/1997 | Lawate |
| 6,087,307 | A | 7/2000 | Kaminski et al. |
| 6,458,750 | B1 | 10/2002 | Dardin et al. |
| 6,667,285 | B1 | 12/2003 | Kawahara et al. |

FOREIGN PATENT DOCUMENTS

| | | | |
|---|---|---|---|
| CA | 2034144 | | 1/1990 |
| EP | 246612 | A2 | 11/1987 |
| EP | 355977 | A1 | 2/1990 |
| EP | 524783 | A1 | 1/1993 |
| WO | 96/13477 | | 5/1996 |
| WO | 03/076555 | A1 | 9/2003 |
| WO | WO 2004087789 | A2 * | 10/2004 |

* cited by examiner

*Primary Examiner* — Vishal Vasisth
(74) *Attorney, Agent, or Firm* — Steven W. Mork

(57) ABSTRACT

Certain polyalkylene glycols, useful as lubricant additives, are soluble with all four types of hydrocarbon base oils (Groups I-IV) at a wide variety of ratios of oil to polyalkylene glycol and under a variety of conditions. These polyalkylene glycols are prepared by reacting a C8-C20 alcohol and a mixed butylene oxide/propylene oxide feed, wherein the ratio of butylene oxide to propylene oxide ranges from 3:1 to 1:1. The invention provides a means of providing desirable lubricant compositions which may pose fewer environmental problems.

12 Claims, No Drawings

POLYAKYLENE GLYCOLS USEFUL AS LUBRICANT ADDITIVES FOR GROUPS I-IV HYDROCARBON OILS

CROSS REFERENCE TO RELATED APPLICATIONS

This application is a 35 USC §371 national phase filing of PCT/US2010/043001 filed Jul. 23, 2010, which claims the benefit of U.S. Application No. 61/227,833, filed Jul. 23, 2009.

BACKGROUND

1. Field of the Invention

The invention relates to lubricant compositions. More particularly, the invention relates to lubricant additives that are soluble with a wide variety of hydrocarbon oils.

2. Background of the Art

Lubricant compositions are widely used in devices with moving mechanical parts, in which their role is to reduce friction between the moving parts. This reduction may, in turn, reduce wear and tear and/or improve the device's overall performance. In many applications lubricant compositions also serve related and non-related supplemental purposes, such as reducing corrosion, cooling components, reducing fouling, controlling viscosity, demulsifying, and/or increasing pumpability.

Most lubricant compositions today include a base oil. Generally this base oil is a hydrocarbon oil or a combination of hydrocarbon oils. The hydrocarbon oils have been designated by the American Petroleum Institute as falling into Group I, II, III or IV. Of these, the Group I, II, and III oils are natural mineral oils. Group I oils are composed of fractionally distilled petroleum which is further refined with solvent extraction processes to improve properties such as oxidation resistance and to remove wax. Group II oils are composed of fractionally distilled petroleum that has been hydrocracked to further refine and purify it. Group III oils have similar characteristics to Group II oils, with Groups II and III both being highly hydro-processed oils which have undergone various steps to improve their physical properties. Group III oils have higher viscosity indexes than Group II oils, and are prepared by either further hydrocracking of Group II oils, or by hydrocracking of hydroisomerized slack wax, which is a byproduct of the dewaxing process used for many of the oils in general. Group IV oils are synthetic hydrocarbon oils, which are also referred to as polyalphaolefins (PAOs).

In order to modify properties of the various base oils, so-called additive packages are frequently employed. Such may include materials designed to serve as antioxidants, corrosion inhibitors, antiwear additives, foam control agents, yellow metal passivators, dispersants, detergents, extreme pressure additives, friction reducing agents, and/or dyes. It is highly desirable that all additives are soluble in the base oil. Such solubility is desirably maintained or maintainable across a wide range of temperature and other conditions, in order to enable shipping, storage, and/or relatively prolonged use of these compositions. It is also highly desirable that the additives offer good environmental performance. This implies that such are not required to carry any hazard classification warning label, and/or are biodegradable and non-toxic to aquatic organisms. However, attainment of these desirable qualities should not be at the expense of overall performance. Unfortunately, many additives that include, as at least one benefit, improved friction reduction suffer from low solubility, poor environmental performance, or both.

Those skilled in the art have attempted to identify friction reduction additives (herein termed "lubricant additives") that may be included in lubricant compositions with base oils and that do not pose problems relating to both solubility and the environment. One approach to this problem has been to include one or more co-base oils, such as synthetic esters or vegetable oils, in the lubricant composition. For example, esters have been used as co-base oils with polyalphaolefins for this purpose. Unfortunately, such esters often suffer from poor hydrolytic stability, and thus may represent an unacceptable sacrifice in overall performance in order to achieve solubility and environmental acceptance.

Another approach to the problem has been to use lubricant additives containing zinc, sulfur, and/or phosphorus. While these lubricant additives often offer both desirable friction reduction and supplemental properties, such as corrosion resistance, they may be non-biodegradable and/or toxic to the environment. They also tend to be relatively expensive. Examples of these additives may include amine phosphates, phosphate esters, chlorinated paraffinics, zinc dialkyldithiophosphates, zinc diamyldithiocarbamate, and diamyl ammonium diamyldithiocarbamate.

Still another approach has been to use lubricant additives that are polyalkylene glycols, or "PAGs." Many PAGs are based on ethylene oxide or propylene oxide homopolymers, and are in some cases ethylene oxide/propylene oxide copolymers. They often offer good performance and environmental properties, including good hydrolytic stability, low toxicity and biodegradability, high viscosity index values, desirable low temperature properties, and good film-forming properties. Unfortunately, they are generally not soluble in hydrocarbon base oils. In particular, their solublility with polyalphaolefins (Group IV oils) is particularly low. Those skilled in art therefore continue to search for polyalkylene glycols that have improved oil solubility in order to take advantage of their many benefits while minimizing the likelihood of environmental problems.

SUMMARY OF THE INVENTION

Accordingly, the present invention provides, in one aspect, a lubricant composition comprising a Group I, II, III or IV hydrocarbon oil and a PAG, the polyalkylene glycol having been prepared by reacting a C8-C20 alcohol and a mixed butylene oxide/propylene oxide feed, wherein the ratio of butylene oxide to propylene oxide ranges from 3:1 to 1:3, the hydrocarbon oil and the polyalkylene glycol being soluble with one another.

In another aspect the invention provides a method of preparing a lubricant composition comprising blending at least (a) a Group I, II, III or IV hydrocarbon oil, and (b) a polyalkylene glycol prepared by reacting a C8-C20 alcohol and a mixed butylene oxide/propylene oxide feed, wherein the ratio of butylene oxide to propylene oxide ranges from 3:1 to 1:3; under conditions such that the hydrocarbon oil and the polyalkylene glycol are soluble with one another.

DETAILED DESCRIPTION OF THE EMBODIMENTS

The invention is a physical blend of a hydrocarbon oil, which may be synthetic or mineral in nature, and a group of PAG lubricant additives which are defined as additives that enhance the friction reducing properties of the blend beyond any that may be exhibited by the hydrocarbon oil alone. The invention further includes a method of preparing this blend.

The PAGs useful herein may be characterized herein by way of both their generalized preparation route and certain common aspects of their structures. Their preparation route generally involves the reaction of an alcohol and a feed that includes both butylene oxide and propylene oxide. A wide ratio of proportions of the feed oxides may be employed, such that the butylene oxide to propylene oxide ratio may range from 3:1 to 1:3. In some non-limiting embodiments a random distribution of the oxide units is preferred, while in other embodiments a block structure may be created by controlling the feed such that the oxides are fed separately and/or alternated.

Such PAGs useful in the invention may, more specifically, be prepared by the reaction of at least 1,2-butylene oxide, propylene oxide, and the selected alcohol. In some embodiments, a mixture of specified alcohol initiators may be selected. The alcohol may be obtained from either petrochemical or renewable resources, and is in general a C8-C20 alcohol which may be linear or branched in nature. In certain non-limiting embodiments it is a C8-C12 alcohol. As used herein, designations beginning with "C," including but not limited to C8, C10, C12, and C20, refer to the total number of carbon atoms in a given molecule, regardless of the configuration of these atoms. Hyphenated expressions including such carbon number designations, such as C8-C12, refer to a group of possible selections of molecules, each selection having a carbon number falling within the given numerical range. This reaction may be catalyzed by either an acidic or basic catalyst. In certain non-limiting embodiments, the catalyst is an alkali base, such as potassium hydroxide, sodium hydroxide, or sodium carbonate, and the process is an anionic polymerization. The result is a polyether structure having a relatively narrower molecular weight distribution, that is, a relatively lower polydispersity index, than may be obtained when the polymerization proceeds cationically. However, in alternative and non-limiting embodiments, cationic polymerization may be performed. The polymer chain length will also depend upon the ratio of the reactants, but in certain non-limiting embodiments the number average molecular weight (Mn) may vary from 500 to 5,000, and in certain other non-limiting embodiments may vary from 500 to 2,500.

In an alternative characterization, the PAGs useful in the present invention may be characterized as butylene oxide/propylene oxide-extended copolymers, based on primary hydroxyl group-containing initiators and having a carbon to oxygen ratio of at least 3:1, and in certain embodiments, from 3:1 to 6:1. In certain particular but non-limiting embodiments the initiators are monols.

A particular aspect of the present invention is that the specified PAG lubricant additives are not only soluble in Groups I-III hydrocarbon oils, but because they are soluble in essentially all lubricant-to-hydrocarbon oil ratios therewith, they may be accurately characterized as being miscible. As defined herein, the terms "soluble" and "miscible" both imply that the two components, which are the hydrocarbon oil and the lubricant PAG additive, as a physical blend, (1) maintain a single phase for a period of at least one week, and (2) during the same time period, do not exhibit turbidity; both as viewed by the unenhanced human eye. The distinction is that, to be "miscible," such solubility must be found across the full range of oil-to-PAG proportions, from a ratio of 90/10 to 10/90, weight/weight. In the present invention the lubricant PAGs are both soluble and miscible in all Groups I, II and III hydrocarbon oils, and are soluble in all Group IV hydrocarbon oils in which there is more hydrocarbon oil than PAG, that is, where the PAO to PAG ratio is greater than 1:1 on a weight/weight basis. This includes Group IV hydrocarbon oils that are low, medium or high in viscosity, that is, that exhibit a kinematic viscosity at 40° C. ranging from 5.5 centistokes (cSt) to 1400 cSt. In some embodiments the PAGs used in the invention may be soluble in Group IV hydrocarbon oils that are low or medium in viscosity even where the PAO to PAG ratio is 1:1 or less.

Such solubility is further defined as a function of temperature. In the inventive lubricant compositions, the solublility must occur both upon initial mixing and at at least one test temperature for at least one week. Temperatures used for solubility testing herein include ambient temperature, which is about 25 degrees Celsius (° C.); 80° C.; and −10° C. For purposes herein, lubricant compositions that are comprehended by the invention include embodiments exhibiting solubility upon initial mixing and continuing under at least one of the test temperatures, or within the full range of the three given temperatures (−10° C. to 80° C.), for at least one week.

In contrast, conventional PAG lubricant additives known in the industry are often not soluble in base Groups I, II, III or IV hydrocarbon oils at levels greater than just five (5) percent on a weight/weight basis, and therefore also cannot be defined as being miscible in any of these hydrocarbon oils. This means that the inventive blends may be used in many applications that previously required other, non-PAG lubricant additives, frequently those having associated environmental or other performance issues, in order to ensure useful degrees of solubility.

EXAMPLES

Example 1

Comparative

Three lubricant additives are prepared by using NAFOL™ 12-99, a linear C12 dodecanol available from Sasol North America, Inc., as an initiator and anionically polymerizing therewith, in the presence of potassium hydroxide as a basic catalyst, a mixed oxide feed of propylene oxide/butylene oxide. The alkylene oxides are added at a reaction temperature of 130° C., in the presence of potassium hydroxide, equivalent to a concentration of 2000 parts per million parts (ppm). At the end of the oxide addition, the reaction is allowed to digest at 130° C. to react all remaining oxide. The catalyst residue is removed by filtration. Any volatiles present are removed by means of vacuum stripping. In the first lubricant additive the ratio of propylene oxide/butylene oxide is 3:1; in the second additive the ratio is 1:1; and in the third additive the ratio is 1:3 weight/weight, which may be alternatively described as percentage ratios of 75/25, 50/50, and 25/75. Each lubricant additive has a final kinematic viscosity of 46 cSt at 40° C.

Three more lubricant additives are then prepared, using 2-ethylhexanol, a C8 alcohol, as the initiator, and reacting this with a mixed oxide feed of propylene oxide/butylene oxide at weight/weight ratios of 3:1, 1:1 and 1:3, using the process conditions described hereinabove. Each of these lubricant additives also has a final kinematic viscosity of 46 cSt at 40° C.

Physical blends are then prepared using the lubricant additives described hereinabove. Each lubricant additive is added to a single hydrocarbon oil as indicated in Tables 1, 2 and 3, and stirred at ambient temperature for 2 hours. The weight ratio of each oil to the PAG lubricant additive ranges, as shown in the tables, to include blends of oil/PAG, based on weight/weight percentages, of 90/10, 75/25, 50/50, 25/75, and 10/90. All compositions are found to be fully soluble, based on unenhanced visual observation, immediately following the initial stirring period.

The blends are then stored at three different temperatures, as indicated in Tables 1, 2 and 3, ranging to include ambient temperature, 80° C. and −10° C., each for one week. They are then visually inspected and the results recorded in Tables 1, 2 and 3. Terms used to describe the visual appearance of the blends include "clear," "turbid," (that is, cloudy), and "flowing," with numbers including 0, 2, and 3 [layers] used to indicate whether there is no phase separation ("0 [layers]"), separation into 2 layers ("2") or separation into 3 layers ("3"). Embodiments of the invention are those marked with both "clear" and "0." Embodiments that are comparative examples are those marked with either "turbid" and "0," or "clear" or "turbid" in combination either "2" or "3." Inclusion of the descriptive "flowing" in Table 3 is not relevant in differentiating examples of the invention from comparative examples, but rather simply provides the reader with a generalized understanding that viscosity issues did not appear to inhibit or distort the observation process.

The hydrocarbon oils used in the testing are as follows:

NEXBASE™ 2004 is a polyalphaolefin base oil (Group IV) from Neste Oil that has a kinematic viscosity at 100° C. of 4 cSt and is a low viscosity base fluid with a pour point of −69° C.

SPECTRASYN™ 8 is a polyalphaolefin base oil (Group IV) from Exxon Mobil Chemicals which has a kinematic viscosity at 100° C. of 8 cSt and is a medium viscosity base oil with a pour point of −54° C.

SPECTRASYN™ 40 is a polyalpholefin base oil (Group IV) from Exxon Mobil Chemicals which has a kinematic viscosity at 100° C. of 40 cSt and is a high viscosity base oil having a pour point of −36° C.

NEXBASE™ 3080 is a hydroprocessed mineral oil base fluid from Neste Oil that is classified as a Group III mineral oil. It has a pour point of −12° C.

SHELL HVI™ 65 is a mineral oil base fluid that is available from Shell Chemicals and classified as a Group 1 mineral oil. It has a pour point of −12° C.

TABLE 1

| | | 25° C. for 1 week | | | | | |
|---|---|---|---|---|---|---|---|
| | | C12 | | | C8 | | |
| Oil | Oil/PAG | 25/75* | 50/50* | 75/25* | 25/75* | 50/50* | 75/25* |
| Spectrasyn 8 | 90/10 | Clear, 0** | Clear, 0 | Clear, 0 | Clear, 0 | Clear, 0 | Clear, 0 |
| PAO-8 | 75/25 | Clear, 0 | Clear, 0 | Clear, 0 | Clear, 0 | Clear, 0 | Clear, 0 |
| | 50/50 | Clear, 0 | Clear, 0 | Clear, 0 | Clear, 0 | Clear, 0 | Clear, 0 |
| | 25/75 | Clear, 0 | Clear, 0 | Clear, 0 | Clear, 0 | Clear, 0 | Clear, 0 |
| | 10/90 | Clear, 0 | Clear, 0 | Clear, 0 | Clear, 0 | Clear, 0 | Clear, 0 |
| Spectrasyn 40 | 90/10 | Turbid, 0 | Turbid, 0 | Clear, 0 | Turbid, 0 | Turbid, 0 | Clear, 0 |
| PAO-40 | 75/25 | Turbid, 0 | Turbid, 0 | Clear, 0 | Turbid, 0 | Turbid, 0 | Clear, 0 |
| | 50/50 | Turbid, 2** | Turbid, 3** | Clear, 0 | Turbid, 2 | Turbid, 2 | Turbid, 3 |
| | 25/75 | Turbid, 2 | Turbid, 2 | Clear, 0 | Turbid, 2 | Turbid, 2 | Turbid, 2 |
| | 10/90 | Turbid, 2 | Turbid, 2 | Clear, 0 | Turbid, 2 | Turbid, 2 | Turbid, 2 |
| Nexbase | 90/10 | Clear, 0 | Clear, 0 | Clear, 0 | Clear, 0 | Clear, 0 | Clear, 0 |
| 2004 | 75/25 | Clear, 0 | Clear, 0 | Clear, 0 | Clear, 0 | Clear, 0 | Clear, 0 |
| PAO-4 | 50/50 | Clear, 0 | Clear, 0 | Clear, 0 | Clear, 0 | Clear, 0 | Clear, 0 |
| | 25/75 | Clear, 0 | Clear, 0 | Clear, 0 | Clear, 0 | Clear, 0 | Clear, 0 |
| | 10/90 | Clear, 0 | Clear, 0 | Clear, 0 | Clear, 0 | Clear, 0 | Clear, 0 |
| Nexbase | 90/10 | Clear, 0 | Clear, 0 | Clear, 0 | Clear, 0 | Clear, 0 | Clear, 0 |
| 3080 | 75/25 | Clear, 0 | Clear, 0 | Clear, 0 | Clear, 0 | Clear, 0 | Clear, 0 |
| Group III | 50/50 | Clear, 0 | Clear, 0 | Clear, 0 | Clear, 0 | Clear, 0 | Clear, 0 |
| mineral oil | 25/75 | Clear, 0 | Clear, 0 | Clear, 0 | Clear, 0 | Clear, 0 | Clear, 0 |
| | 10/90 | Clear, 0 | Clear, 0 | Clear, 0 | Clear, 0 | Clear, 0 | Clear, 0 |
| Shell HVI 65 | 90/10 | Clear, 0 | Clear, 0 | Clear, 0 | Clear, 0 | Clear, 0 | Clear, 0 |
| Group I | 75/25 | Clear, 0 | Clear, 0 | Clear, 0 | Clear, 0 | Clear, 0 | Clear, 0 |
| mineral oil | 50/50 | Clear, 0 | Clear, 0 | Clear, 0 | Clear, 0 | Clear, 0 | Clear, 0 |
| | 25/75 | Clear, 0 | Clear, 0 | Clear, 0 | Clear, 0 | Clear, 0 | Clear, 0 |
| | 10/90 | Clear, 0 | Clear, 0 | Clear, 0 | Clear, 0 | Clear, 0 | Clear, 0 |

*refers to BO/PO ratio.

**the number following the appearance designation (clear, turbid) refers to the number of layers seen upon visual inspection, for example, 0 layers indicating no phase separation, 2 layers, or 3 layers.

TABLE 2

| | | 80° C. for 1 week | | | | | |
|---|---|---|---|---|---|---|---|
| | Oil/ | C12 | | | C8 | | |
| Oil | PAG | 25/75* | 50/50* | 75/25* | 25/75* | 50/50* | 75/25* |
| Spectrasyn 8 | 90/10 | Clear, 0** | Clear, 0 | Clear, 0 | Clear, 0 | Clear, 0 | Clear, 0 |
| PAO-8 | 75/25 | Clear, 2** | Clear, 0 | Clear, 0 | Clear, 2 | Clear, 0 | Clear, 0 |
| | 50/50 | Clear, 2 | Clear, 0 | Clear, 0 | Clear, 2 | Clear, 0 | Clear, 0 |
| | 25/75 | Clear, 2 | Clear, 0 | Clear, 0 | Clear, 2 | Clear, 2 | Clear, 2 |
| | 10/90 | Clear, 2 | Clear, 0 | Clear, 0 | Clear, 2 | Clear, 2 | Clear, 2 |

TABLE 2-continued

| | | 80° C. for 1 week | | | | | |
|---|---|---|---|---|---|---|---|
| | Oil/ | C12 | | | C8 | | |
| Oil | PAG | 25/75* | 50/50* | 75/25* | 25/75* | 50/50* | 75/25* |
| Spectrasyn 40 | 90/10 | Turbid, 2** | Turbid, 0 | Clear, 0 | Turbid, 2 | Turbid, 0 | Clear, 0 |
| PAO-40 | 75/25 | — | — | — | — | — | — |
| | 50/50 | Turbid, 3** | Clear, 0 | Clear, 0 | Turbid, 3 | Clear, 0 | Clear, 0 |
| | 25/75 | — | — | — | — | — | — |
| | 10/90 | Turbid, 2 | Clear, 0 | Clear, 0 | Turbid, 2 | Turbid, 2 | Clear, 0 |
| Nexbase 2004 | 90/10 | Clear, 0 | Clear, 0 | Clear, 0 | Clear, 0 | Clear, 0 | Clear, 0 |
| PAO-4 | 75/25 | Clear, 0 | Clear, 0 | Clear, 0 | Clear, 0 | Clear, 0 | Clear, 0 |
| | 50/50 | Clear, 0 | Clear, 0 | Clear, 0 | Clear, 0 | Clear, 0 | Clear, 0 |
| | 25/75 | Clear, 0 | Clear, 0 | Clear, 0 | Clear, 0 | Clear, 0 | Clear, 0 |
| | 10/90 | Clear, 0 | Clear, 0 | Clear, 0 | Clear, 0 | Clear, 0 | Clear, 0 |
| Nexbase 3080 | 90/10 | Clear, 0 | Clear, 0 | Clear, 0 | Clear, 0 | Clear, 0 | Clear, 0 |
| Group III | 75/25 | Clear, 0 | Clear, 0 | Clear, 0 | Clear, 0 | Clear, 0 | Clear, 0 |
| mineral oil | 50/50 | Clear, 0 | Clear, 0 | Clear, 0 | Clear, 0 | Clear, 0 | Clear, 0 |
| | 25/75 | Clear, 0 | Clear, 0 | Clear, 0 | Clear, 0 | Clear, 0 | Clear, 0 |
| | 10/90 | Clear, 0 | Clear, 0 | Clear, 0 | Clear, 0 | Clear, 0 | Clear, 0 |
| Shell HVI 65 | 90/10 | Clear, 0 | Clear, 0 | Clear, 0 | Clear, 0 | Clear, 0 | Clear, 0 |
| Group I | 75/25 | Clear, 0 | Clear, 0 | Clear, 0 | Clear, 0 | Clear, 0 | Clear, 0 |
| mineral oil | 50/50 | Clear, 0 | Clear, 0 | Clear, 0 | Clear, 0 | Clear, 0 | Clear, 0 |
| | 25/75 | Clear, 0 | Clear, 0 | Clear, 0 | Clear, 0 | Clear, 0 | Clear, 0 |
| | 10/90 | Clear, 0 | Clear, 0 | Clear, 0 | Clear, 0 | Clear, 0 | Clear, 0 |

*refers to BO/PO ratio.

**the number following the appearance designation (clear, turbid) refers to the number of layers seen upon visual inspection, for example, 0 layers indicating no phase separation, 2 layers, or 3 layers.

— indicates no data obtained.

TABLE 3

| | | 10° C. for 1 week | | | | | | |
|---|---|---|---|---|---|---|---|---|
| | Base oil without PAG; | | C12 | | | C8 | | |
| Oil | Pour point | Oil/PAG | 25/75* | 50/50* | 75/25* | 25/75* | 50/50* | 75/25* |
| Spectrasyn 8 | Flowing & | 90/10 | Flowing, | Flowing, | Flowing, | Flowing, | Flowing, | Flowing, |
| PAO-8 | clear; | | 2, | 0, Clear | 0, Clear | 2, turbid | 2, turbid | 0, Clear |
| | −54° C. | | turbid, | | | | | |
| | | 75/25 | Flowing, | Flowing, | Flowing, | Flowing, | Flowing, | Flowing, |
| | | | 2, turbid | 0, clear | 0, clear | 2, turbid | 2, turbid | 0, clear |
| | | 50/50 | Flowing, | Flowing, | Flowing, | Flowing, | Flowing, | Flowing, |
| | | | 2, turbid | 0, clear | 0, clear | 2, turbid | 2, turbid | 0, clear |
| | | 25/75 | Flowing, | Flowing, | Flowing, | Flowing, | Flowing, | Flowing, |
| | | | 2, turbid | 0, clear | 0, clear | 2, turbid | 2, turbid | 0, clear |
| | | 10/90 | Flowing, | Flowing, | Flowing, | Flowing, | Flowing, | Flowing, |
| | | | 0, clear | 0, clear | 0, clear | 2 turbid | 0, clear | 0, clear |
| Spectrasyn 40 | Flowing & | 90/10 | Flowing, | Flowing, | Flowing, | Flowing, | Flowing, | Flowing, |
| PAO-40 | clear; | | 0, turbid | 0, turbid | 0, turbid | 0, turbid | 0, turbid | 0, turbid |
| | −36° C. | 75/25 | — | — | — | — | — | — |
| | | 50/50 | Flowing, | Flowing, | Flowing, | Flowing, | Flowing, | Flowing, |
| | | | 2, turbid | 2, turbid | 0, turbid | 2, turbid | 2, turbid | 2 turbid |
| | | 25/75 | — | — | — | — | — | — |
| | | 10/90 | Flowing, | Flowing, | Flowing, | Flowing, | Flowing, | Flowing, |
| | | | 2, turbid | 2, turbid | 0, turbid | 2, turbid | 2, turbid | 2, turbid |
| Nexbase 2004 | Flowing & | 90/10 | Flowing, | Flowing, | Flowing, | Flowing, | Flowing, | Flowing, |
| PAO-4 | clear; | | 0, clear | 0 clear | 0, clear | 0, clear | 0, clear | 0, clear |
| | −69° C. | 75/25 | — | — | — | — | — | — |
| | | 50/50 | Flowing, | Flowing, | Flowing, | Flowing, | Flowing, | Flowing, |
| | | | 0, clear | 0, clear | 0, clear | 0, clear | 0, clear | 0, clear |
| | | 25/75 | — | — | — | — | — | — |
| | | 10/90 | Flowing, | Flowing, | Flowing, | Flowing, | Flowing, | Flowing, |
| | | | 0, clear | 0, clear | 0, clear | 0, turbid | 0, clear | 0, clear |
| Nexbase 3080 | Flowing & | 90/10 | Flowing, | Flowing, | Flowing, | Flowing, | Flowing, | Flowing, |
| Group III | turbid; | | 0, turbid | 0, turbid | 0, turbid | 2, turbid | 0, turbid | 0, turbid |
| mineral oil | −12° C. | 75/25 | — | — | — | — | — | — |
| | | 50/50 | Flowing, | Flowing, | Flowing, | Flowing, | Flowing, | Flowing, |
| | | | 2, turbid | 0, turbid | 0, turbid | 3, turbid | 3, turbid | 0, turbid |
| | | 25/75 | — | — | — | — | — | — |
| | | 10/90 | Flowing, | Flowing, | Flowing, | Flowing, | Flowing, | Flowing, |
| | | | 0, turbid | 0, turbid | 0, turbid | 0, turbid | 0, turbid | 0, turbid |

TABLE 3-continued

| | | | 10° C. for 1 week | | | | | |
|---|---|---|---|---|---|---|---|---|
| | Base oil without PAG; | | C12 | | | C8 | | |
| Oil | Pour point | Oil/PAG | 25/75* | 50/50* | 75/25* | 25/75* | 50/50* | 75/25* |
| Shell HVI 65 Group I mineral oil | Flowing & clear; −12° C. | 90/10 | Flowing, 0, clear | Flowing, 0, clear | Flowing, 0, clear | Flowing, 0, clear | Flowing, 0, clear | Flowing, 0, clear |
| | | 75/25 | — | — | — | — | — | — |
| | | 50/50 | Flowing, 0, turbid | Flowing, 0, turbid | Flowing, 0, turbid | Flowing, 0, turbid | Flowing, 0, turbid | Flowing, 0, turbid |
| | | 25/75 | — | — | — | — | — | — |
| | | 10/90 | Flowing, 0, turbid | Flowing, 0, turbid | Flowing, 0, turbid | Flowing, 0, turbid | Flowing, 0, turbid | Flowing, 0, turbid |

*refers to BO/PO ratio.

**the number following the appearance designation (clear, turbid) refers to the number of layers seen upon visual inspection, for example, 0 layers indicating no phase separation, 2 layers, or 3 layers.

— indicates no data obtained.

Example 2

Comparative

Five lubricant additives are prepared using NAFOL™ 10D, a C10 alcohol available from Sasol North America, Inc., as an initiator and anionically polymerizing therewith, in the presence of potassium hydroxide as a basic catalyst, a 100 percent PO feed, a 100 percent BO feed, or a mixed oxide feed of propylene oxide/butylene oxide. The ratios of propylene oxide/butylene oxide in the mixed feeds are 3:1, 1:1 and 1:3, alternatively expressed in percentages as 75/25, 50/50, and 25/75, weight/weight, respectively. Kinematic viscosity is 46 cSt at 40° C.

Four more lubricant additives are then prepared, using NAFOL™ 1618H, a mixed linear C16/C18 alcohol available from Sasol North America, Inc., as the initiator, and reacting this with a feed of 100 percent BO or a mixed oxide feed of propylene oxide/butylene oxide at weight/weight ratios of 3:1, 1:1 and 1:3, alternatively expressed in percentages as 75/25, 50/50, and 25/75, weight/weight, respectively, using the process conditions described hereinabove in Example 1 (Comparative). Kinematic viscosity is 46 cSt at 40° C.

Five more lubricant additives are prepared using DOWANOL™ DPnB, a dipropylene glycol n-butyl ether, a branched C10 alcohol that is available from The Dow Chemical Company, as a starter and anionically polymerizing therewith, in the presence of potassium hydroxide as a basic catalyst, a 100 percent PO feed, a 100 percent BO feed, or a mixed oxide feed of propylene oxide/butylene oxide. The ratios of propylene oxide/butylene oxide in the mixed feeds are, expressed as percentages, 75/25, 50/50, and 25/75, weight/weight. Kinematic viscosity is 46 cSt at 40° C.

Physical blends are then prepared using the lubricant additives described hereinabove. Each lubricant additive is added to SPECTRASYN™ 8 as indicated in Table 4, and stirred at ambient temperature for 2 hours. The weight ratio of oil to the lubricant additive is 90/10, weight/weight. All compositions are found to be fully soluble, based on unenhanced visual observation, immediately following the initial stirring period.

The blends are then stored at two different temperatures for one week, as indicated in Table 4, including at 20° C. or at 80° C. They are then visually inspected and the results recorded in Table 4. Embodiments within the invention are those marked with both "clear" and "0," while those that are comparatives are marked with "turbid" and

TABLE 4

| Initiator PO/BO, w/w | T = 20° C. | T = 80° C. |
|---|---|---|
| NAFOL ™ 10D initiator | | |
| 100PO | turbid, 0* | clear, 0 |
| 75PO/25BO | clear, 0 | clear, 0 |
| 50PO/50BO | clear, 0 | clear, 0 |
| 25PO/75BO | clear, 0 | clear, 0 |
| 100BO | clear, 0 | clear, 0 |
| NAFOL ™ 1618H initiator | | |
| 75PO/25BO | clear, 0 | clear, 0 |
| 50PO/50BO | clear, 0 | clear, 0 |
| 25PO/75BO | clear, 0 | clear, 0 |
| 100BO | clear, 0 | clear, 0 |
| DOWANOL ™ DPnB started | | |
| 100PO | turbid, 0 | clear, 0 |
| 70PO/30BO | turbid, 0 | clear, 0 |
| 50PO/50BO | clear, 0 | clear, 0 |
| 25PO/75BO | clear, 0 | clear, 0 |
| 100BO | clear, 0 | clear, 0 |

*0 indicates that there is no phase separation seen.

What is claimed is:

1. A lubricant composition comprising a Group I, II, III or IV hydrocarbon oil and a polyalkylene glycol, the polyalkylene glycol having been prepared by reacting a C8-C20 alcohol and a mixed 1,2-butylene oxide/propylene oxide feed, wherein the ratio of 1,2-butylene oxide to propylene oxide ranges from 3:1 to 1:3, the hydrocarbon oil and the polyalkylene glycol being soluble with one another.

2. The lubricant composition of claim 1 wherein the alcohol is a C8-C12 alcohol.

3. The lubricant composition of claim 2 wherein the alcohol is 2-ethylhexanol, dodecanol, or a mixture thereof.

4. The lubricant composition of claim 1 wherein the polyalkylene glycol and the hydrocarbon oil are soluble with one another at a hydrocarbon oil to polyalkylene glycol ratio ranging from 90/10 to 10/90.

5. The lubricant composition of claim 4 wherein the hydrocarbon oil is a Group IV hydrocarbon oil and the polyalkylene glycol and the hydrocarbon oil are soluble with one another at a hydrocarbon oil to polyalkylene glycol ratio ranging from 90/10 to greater than 50/50.

6. The lubricant composition of claim 1 wherein the hydrocarbon oil and the polyalkylene glycol are soluble with one another for at least one week under at least one temperature selected from 25° C., 80° C., or −10° C.

7. The lubricant composition of claim 6 wherein the hydrocarbon oil and the polyalkylene glycol are soluble with one another for at least one week under temperatures ranging from −10° C. to 80° C.

8. The lubricant composition of claim 1 wherein the alcohol is dodecanol and the ratio of butylene oxide to propylene oxide is from 3:1 to 1:1.

9. The lubricant composition of claim 8 wherein the polyalkylene glycol and the hydrocarbon oil are soluble with one another at temperatures from −10° C. to 80° C. over at least one week.

10. The lubricant composition of claim 1 wherein the polyalkylene glycol has a carbon to oxygen ratio that is at least 3:1.

11. The lubricant composition of claim 10 wherein the polyalkylene glycol has a carbon to oxygen ratio that is from 3:1 to 6:1.

12. A method of preparing a lubricant composition comprising blending at least (a) a Group I, II, III or IV hydrocarbon oil, and (b) a polyalkylene glycol prepared by reacting a C8-C20 alcohol and a mixed 1,2-butylene oxide/propylene oxide feed, wherein the ratio of 1,2-butylene oxide to propylene oxide ranges from 3:1 to 1:3; under conditions such that the hydrocarbon oil and the polyalkylene glycol are soluble with one another.

* * * * *